US008231092B2

(12) United States Patent
Shpitalni

(10) Patent No.: US 8,231,092 B2
(45) Date of Patent: Jul. 31, 2012

(54) SHELF SUPPORT

(75) Inventor: Amir Shpitalni, Tel Aviv (IL)

(73) Assignee: Spiral Supports Ltd., Haifa (IL)

( * ) Notice: Subject to any disclaimer, the term of this patent is extended or adjusted under 35 U.S.C. 154(b) by 272 days.

(21) Appl. No.: 12/451,829

(22) PCT Filed: Jun. 2, 2008

(86) PCT No.: PCT/IL2008/000741

§ 371 (c)(1),
(2), (4) Date: Dec. 2, 2009

(87) PCT Pub. No.: WO2008/149340

PCT Pub. Date: Dec. 11, 2008

(65) Prior Publication Data

US 2010/0116959 A1 May 13, 2010

(30) Foreign Application Priority Data

Jun. 7, 2007 (IL) ..... 183736

(51) Int. Cl.
*A47G 29/02* (2006.01)
*A47B 96/07* (2006.01)

(52) U.S. Cl. ..... 248/250; 248/235; 248/239

(58) Field of Classification Search ..... 248/250, 248/235, 239, 241, 242, 201; 108/108, 42; D8/381
See application file for complete search history.

(56) References Cited

U.S. PATENT DOCUMENTS

| | | | | | |
|---|---|---|---|---|---|
| 2,542,753 | A * | 2/1951 | de Swart | 248/239 |
| 3,759,191 | A | 9/1973 | Freeman | |
| 3,945,595 | A * | 3/1976 | Schlueter | 248/239 |
| 5,326,061 | A * | 7/1994 | Hamilton | 248/239 |
| 6,520,704 | B1 * | 2/2003 | Vidmar et al. | 403/188 |
| 6,722,620 | B2 | 4/2004 | Rieger | |
| D506,384 | S * | 6/2005 | Lawrence et al. | D8/381 |
| 6,986,488 | B2 * | 1/2006 | Migli | 248/250 |
| D618,989 | S * | 7/2010 | Shpitalni | D8/381 |

FOREIGN PATENT DOCUMENTS

| | | | |
|---|---|---|---|
| AU | 496094 | B2 | 12/1976 |
| DE | 24 60 930 | A1 | 7/1976 |
| DE | 43 37 927 | A1 | 5/1995 |
| EP | 0 455 609 | A1 | 11/1991 |
| FR | 2 878 297 | A1 | 5/2006 |
| GB | 2 124 892 | A | 2/1984 |
| GB | 2 269 981 | A | 3/1994 |

OTHER PUBLICATIONS

International Search Report for PCT/IL2008/000741, mailed on Nov. 24, 2008; 2 pages.

* cited by examiner

*Primary Examiner* — Anita M King
(74) *Attorney, Agent, or Firm* — Vorys, Sater, Seymour and Pease LLP; Susanne M. Hopkins; William L. Klima

(57) ABSTRACT

A shelf support including a rod portion and a seating portion extending therefrom is provided. The rod portion is adapted for fixing to a support wall. The seating portion includes a spiral-shaped outer surface which constitutes a plurality of support surfaces for supporting a bottom portion of a shelf, where, when the rod portion is fixed to the support wall and the bottom portion of the shelf is disposed above the seating portion, rotation of the shelf support causes a portion of the spiral-shaped outer surface to engage the bottom portion of the shelf.

18 Claims, 5 Drawing Sheets

SHELF SUPPORT

This is a National Phase Application filed under 35 U.S.C. 371 as a national stage of PCT/IL 2008/000741, filed Jun. 2, 2008, the content of which is hereby incorporated by reference in its entirety.

FIELD OF THE INVENTION

This invention relates to shelf supports having more than one support surface adapted for seating a portion of a shelf thereon, and more specifically to shelf supports adapted to allow a user to select a support surface to engage the portion of the shelf.

BACKGROUND OF THE INVENTION

Shelves are commonly supported by three or more shelf supports or support brackets. A shelf support may be fixed to a support wall of a building or a piece of furniture, after which a portion of a shelf is brought to rest or seated on a support surface of the shelf support.

In cases where (four) or more shelf supports are used, it is sometimes found that due to poor manufacturing of the support wall, bores formed therein and/or of the shelf supports, a shelf does not rest on one, or more, of the shelf supports and is spaced vertically therefrom, and/or that the shelf rests on the shelf supports in a non-level manner, and/or that the shelf is distanced horizontally from adjacent walls between which it is disposed. The above scenarios are undesirable and may cause instability of the shelf which may lead to flipping thereof or instability of the items placed on the shelf. To overcome some of the above-described problems varying types of shelf supports are known.

EP 0,455,609 discloses a concealed support device to fasten a shelf to a wall, characterized in that it comprises: a plate designed to be fastened to a wall; a supporting arm longitudinally insertable in a housing provided in a shelf and having a hooking end oscillatably fixed to an engagement recess offered by the plate; an adjusting member comprising a cam element rotatably engaged to the arm and designed to act against said plate to restrain the angular displacement of the arm about the hooking end; and a vertical set screw operatively engaged to the plate and acting against the cam element so as to give the desired vertical positioning to the supporting arm.

GB 2,124,892 discloses a device, used in conjunction with three other similar devices, comprising two components: a cylinder with a flanged end, the cylinder having a hole throughout its length in a position off centre through which a fixing screw fits; and a housing shaped to fit the cylinder and having support face onto which a horizontal surface can be fixed.

U.S. Pat. No. 3,759,191 discloses a bracket for supporting cabinet shelves which is secured to the cabinet side wall and is rotatable angularly through 180 degrees between two positions. In one position, a pin on the bracket extends upwardly and is insertable in a shelf socket for releasably interlocking the shelf to the cabinet side wall. In the other position, the pin extends downwardly in a disengaged condition, permitting free separation of the shelf from the cabinet side wall.

FR 2,878,297 discloses a support device for tablet, comprising a fixation nozzle with a threaded rod on the one hand, and a support nozzle in periphery from which a tablet is expected to be leant on, the said support nozzle comprising a non round or approximately round section and delimiting, in periphery, at least two support areas for tablet or other located at different distances in relation to the axis of the threaded rod.

SUMMARY OF THE INVENTION

The disclosed subject matter refers to a shelf support which may be adapted for:

- closing a vertical gap which exists between the shelf support and an adjacent shelf portion;
- leveling an inclined shelf resting on the shelf support; and
- closing a horizontal gap which exists between a shelf and an adjacent wall portion.

As per standard design, the shelf may require additional shelf supports to maintain a stable position. The additional shelf supports may be known shelf supports or shelf supports of the present invention.

In accordance with a first aspect of the present invention there is provided a shelf support adapted to be mounted to a support wall via a bore preformed therein and to support a portion of a shelf thereon, the shelf support comprising a rod portion adapted to be mounted to the bore and a seating portion extending from the rod portion and comprising a spiral-shaped outer surface which constitutes a plurality of support surfaces for supporting the shelf, said support surface having a varying radial distance from the center of rotation of the rod portion about its longitudinal axis. The arrangement is such that rotating the shelf support about the rod portion results in varying radial displacement of a portion of the support surface supporting the shelf so as to engage a bottom surface of the shelf and/or facilitate its leveling.

Each portion of the spiral-shaped outer surface may constitute a support surface upon which a shelf may be seated, therefore the shelf support comprises a plurality of support surfaces at varying distances allowing a user to fine tune the position of the shelf support by rotating it, thus bringing one of the support surfaces into contact with an adjacent portion of a shelf. This also allows a user to level a shelf already engaging the shelf support, for example in a case where bores to which shelf supports of a structure are of differing heights.

Furthermore, each support surface on the spiral-shaped outer surface is disposed at a different distance or diameter to the other support surfaces from the center of the seating portion, thus the same diameter is not present twice, allowing for a large range of fine tuning.

The support surface may be a smooth spiral surface or it may have shavings to form discrete flat support surfaces, to extend substantially flush under the supported surface of the shelf.

The rod portion and the seating portion may be integrally formed. Alternatively the seating portion may have a central aperture and the rod portion may be mounted thereto and extend therefrom.

To allow a shelf support of the present invention a greater magnitude of varying distances from the rod to the support surfaces, the rod may be disposed off centre with respect to the seating portion. The rod portion may have a smooth outer surface, allowing it to be easily rotated within a bore.

The spiral shaped outer surface decreases moment of the shelf on the shelf-support and thus reduces the need for a rod portion to protrude completely through a wall to which it is mounted. As the rod portion may remain concealed within the wall unsightly protrusions on the other side of the wall, and external securing elements such as pins, nuts, etc are unnecessary. Consequently the rod portion also need not be secured to the bore via threaded engagement therewith and may be smooth, facilitating easy rotation thereof.

The spiral pattern of the support surface may be formed according to different equations e.g. helical, exponential, etc.

To prevent undesired rotation of a shelf support in accordance with the present invention, the seating portion may further comprise an anti-rotation element. Such anti-rotation element may be in the form of unidirectional teeth or bulges on an outer surface of a shelf support which constitute support surfaces thereof. Optionally, the seating portion may comprise a projection member extending parallel with respect to the rod portion, adapted to contact and cause friction with or even be inserted into a portion of a wall to which such shelf support is mounted. In the latter case rotation of the shelf support is prevented when the seating portion is pressed adjacent to the wall to which the shelf support is mounted. In other cases the shelf support may be rotated even while the seating portion engages the wall.

To provide a lighter and more material-efficient structure, the seating portion may be hollow, with the spiral-shaped outer surface being connected to the rod portion by spokes.

The seating portion may further comprise an axially-projecting lip, disposed adjacent to the rod portion. The lip may also constitute a plurality of support surfaces wherein, when the rod portion is mounted in the horizontal bore of a first wall and a side portion of the shelf is placed adjacent the lip, rotation of the shelf support causes the lip to engage the side portion of the shelf thereby pushing the shelf in a direction away from the first wall and towards an opposing wall.

In accordance with another aspect of the present invention there is provided a shelf support adapted to be mounted to a bore formed within a support wall and to seat a shelf having a lower portion and a side portion thereon, the shelf support comprising a rod portion adapted to be rotatably mounted within the bore, and a seating portion extending therefrom; and comprising an axially-projecting lip disposed adjacent to the rod portion, the lip comprising an axial surface constituting a plurality of support surfaces; and when the rod portion is mounted in the bore and the side portion of the shelf is placed adjacent the lip, rotation of the shelf support causes the axial surface to contact the side portion of the shelf.

In accordance with either of the above aspects, the axial projection of the lip may have a uniform tapered shape or may follow a growth pattern such as helical, exponential or step growth, etc.

A shelf support comprising the above-described axially-projecting lip can serve to secure a shelf mounted thereon in a horizontal plane by pushing it against an opposing wall, thereby preventing flipping and further securing the shelf in a desired position. Additionally, as a result of the above described pushing action, the axially-projecting lip acts as an anti-slip element, as will be explained hereinafter.

Shelf supports in accordance with the above aspects which comprise a spiral-shaped seating portion may also be used in an alternative manner, by disposing a seating portion of the shelf support underneath a corner of a shelf, and allowing the shelf s corner to press down on a portion of the spiral-shaped outer surface thereby causing the shelf support to rotate until an edge of the spiral-shaped outer surface contacts a side-portion of the shelf. This motion may cause the shelf to be pushed towards an opposing wall, thus securing the shelf support and the shelf itself in position.

In accordance with yet another aspect of the present invention there is provided a shelf support adapted to be mounted to a support wall via a bore preformed therein and to support a portion of a shelf thereon, the shelf support comprising: a seating portion and a rod portion extending therefrom; the seating portion comprising a symmetrically-shaped cross section having an outer surface which constitutes a plurality of support surfaces for supporting the shelf; the rod portion being disposed off-center relative to the symmetrically-shaped cross section and adapted to be mounted to the bore. The cross section may be in the shape of a circle, square, hexagon, etc.

Rotation of such shelf support about the off-center rod portion results in varying radial displacement of a portion of the support surface supporting the shelf so as to engage a bottom surface of the shelf and facilitate its leveling. Thus fine-tuning is accomplished without such being visible to a casual onlooker.

In accordance with any of the above aspects a seating portion of the shelf support may be formed with a tool engaging portion e.g. a recess adapted to allow insertion of a tool head therein such as a screw driver, spanner, key, etc, for ease of rotation thereof.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF EMBODIMENTS

Figure 1A:
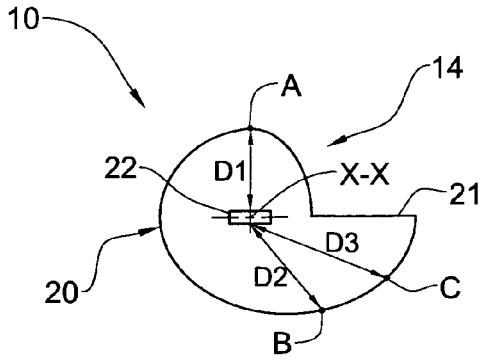
FIG. 1A is a schematic front view of a shelf support according to one embodiment of the present invention.

Referring now to the drawings wherein like reference characters designate like or corresponding parts throughout several views, there is shown in FIGS. 1A-1E, a shelf support generally designated 10 according to one embodiment of the present invention.

Figure 1B:
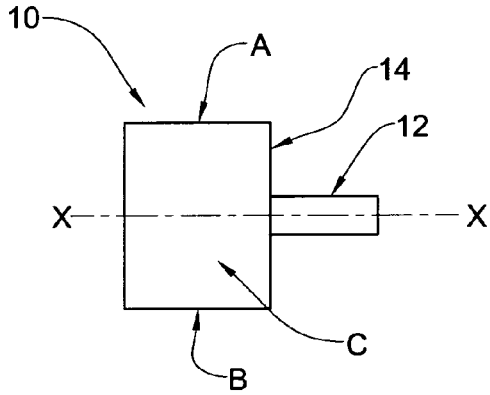
FIG. 1B is a schematic side view of the shelf support in FIG. 1.

Drawing attention first to FIGS. 1A and 1B, the shelf support can be seen to have a substantially cylindrical shape and comprises a cylindrically-shaped rod portion 12 having a smooth outer surface and a central axis X, and a seating portion 14 extending from the rod portion 12. Optionally, the rod portion 12 and the seating portion 14 are integrally formed with each other and are made of a plastic material, which is of sufficient strength to support a standard shelf 16 (FIGS. 1C-1E), when the shelf support 10 is mounted to a side-wall 18 (best seen in FIG. 1C).

The seating portion 14 comprises a spiral-shaped outer surface 20.

Each point of the outer surface 20 along the spiraling portion thereof is disposed at a different distance from the central axis X. To elaborate, example points of the outer surface designated A, B and C are shown to constitute potential support surfaces of the shelf support, wherein diameter D1<D2<D3.

It should be noted, however, that the outer surface 20, further comprises a radially oriented straight portion 21 (seen in FIGS. 1A, 1D and 1E), which connects the support surface having the largest diameter to the support surface having the smallest diameter.

For ease of rotation, the seating portion is optionally formed with a recess 22, which, in this example, is shaped to allow insertion of a screw driver with a slotted tip (not shown).

Figure 1C:
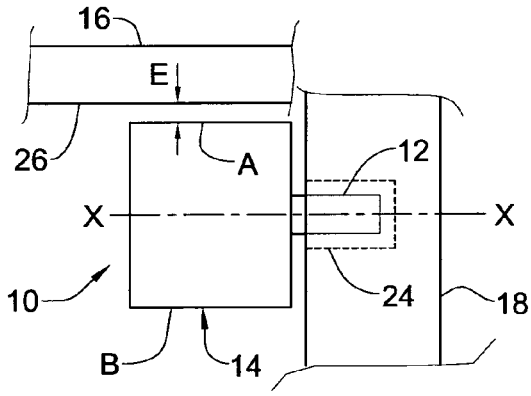
FIG. 1C is a schematic side view of the shelf support of FIG. 1, mounted to a wall and disposed beneath a shelf.
Figure 1D:
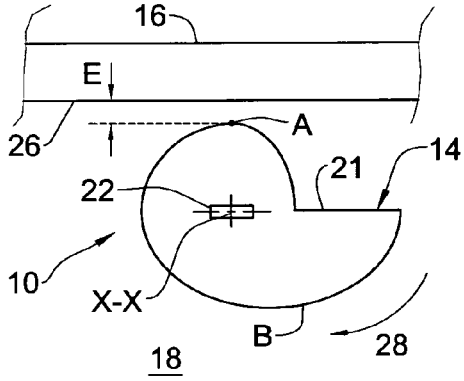
FIG. 1D is a schematic front view of the assembly of FIG. 1C.

Turning attention to FIGS. 1C and 1D, the shelf support 10 is shown to be rotatably mounted via the rod portion 12 thereof to a horizontal bore 24 (FIG. 1C) formed within the wall 18. The seating portion 14 is disposed underneath a lower portion 26 of a shelf 16 which is supported in this position by other shelf supports (not shown). Notably, the shelf is level due to the presence of other shelf supports (not shown) but is unstable due to there being a gap or distance (designated as E) between the shelf and support surface A, which is the closest support surface to the lower portion 26 of the shelf 16. Notably, distance E corresponds in magnitude to the difference of magnitude between diameters D1 and D2, the importance of which will become clear hereinafter.

Figure 1E:
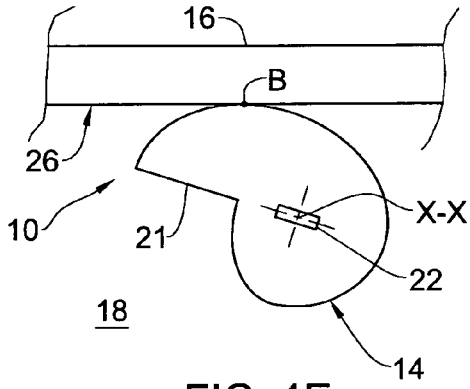
FIG. 1E is a schematic front view of the shelf support, wall and shelf in FIGS. 1C and 1D, with the shelf support rotated clockwise about 200 degrees.

In operation, to stabilize the shelf 16, such that it is seated on the shelf support 10, a user inserts a screw driver tip (not shown) into the recess 22 and rotates the shelf support thereby in the direction of arrow 28 (FIG. 1D) about the central axis X until the orientation of the shelf support is that shown in FIG. 1E, at which point the lower portion 26 of the shelf 16 securely rests on support surface B.

Figure 1F:
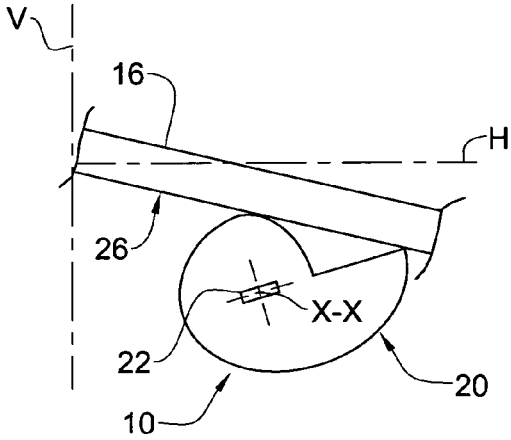
FIG. 1F is a schematic front view of the shelf support of FIG. 1, mounted to a wall and disposed beneath a shelf which is resting thereon.

Drawing attention now to FIG. 1F, the shelf support 10 is shown disposed underneath a lower portion.26 of a shelf 16 which is supported in this position by other shelf supports (not shown). In contrast to FIGS. 1C and 1D the shelf 16 shown in FIG. 1F is not level and is resting on the shelf support 10. To aid visualization only, a horizontal axis designated H and a vertical axis designated V are shown.

The operational steps to level the shelf 16 are similar to those described above, with the shelf support 10 being rotated about 250 degrees in a clockwise direction. During rotation the shelf support 10 continuously contacts and pushes the shelf 16 until the shelf is acceptably leveled, for example until it is parallel with horizontal axis H, in a manner similar to that shown in FIG. 1E.

It should be noted that the above described scenarios are examples only and, for example, a shelf support may be at any orientation with respect to a shelf thereabove and may be rotated any appropriate amount, and to any point on the outer surface 20 to bring the shelf to a desired inclination.

Turning to FIGS. 2A-2D, examples of shelf supports having anti-rotation elements, for ensuring the prevention of undesired reverse rotation of a shelf support, are shown.

Figure 2A:
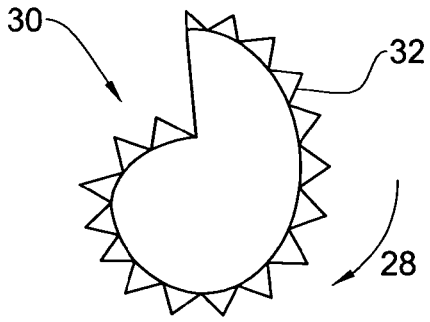
FIGS. 2A and 2B are a schematic front view of embodiments of a shelf support comprising an anti-rotation element.

In FIG. 2A a shelf support designated as 30 comprises an anti-rotation element in the form of unidirectional teeth 32 formed on an outer surface of the shelf support 30.

The teeth 32 act to prevent the shelf support, when in contact with a lower portion of a shelf (not shown), from rotating in the direction opposite to arrow 28.

Figure 2B:
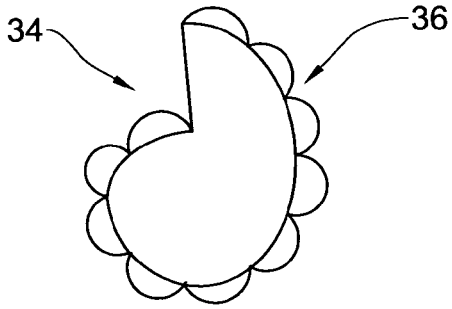

Similarly, FIG. 2B shows a shelf support designated as 34 comprising an anti-rotation element in the form of bulges 36.

Figure 2C:
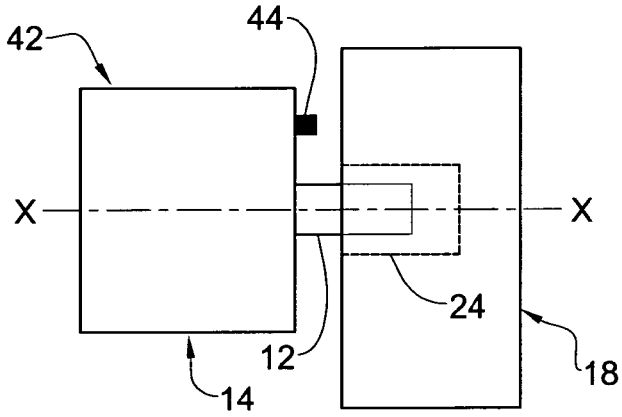
FIG. 2C is a schematic side view of yet another embodiment of a shelf support comprising an anti-rotation element, partially mounted to a wall.
Figure 2D:
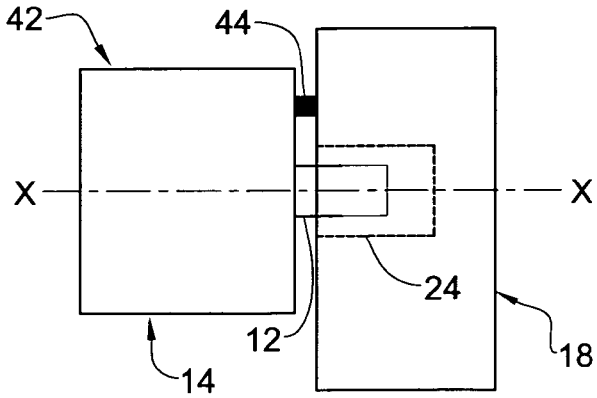
FIG. 2D is a schematic side view of the shelf support in FIG. 2C, mounted to a wall.

FIGS. 2C and 2D show a shelf support designated as 42 comprising an anti-rotation element in the form of an axial projection member 44, optionally made of a rubber material, extending from the seating portion 14 and parallel with respect to the rod portion 12.

In operation, to stabilize a shelf (not shown) disposed above the shelf support 42, a user rotates the shelf support to an orientation where it engages the shelf, while the rod portion 12 of the shelf support 42 is not fully inserted into the bore 24, as seen in FIG. 2C. When the desired orientation is reached, the user fully pushes the shelf support 42 towards the wall 18, as shown in FIG. 2D, wherein further rotation of the shelf support 42 is arrested by the frictional contact of the axial projection member 44 with the wall 18. As should be understood, there may be a plurality of axial projection members, which may have any desired shape and may be made of any material which can produce the desired frictional effect.

Alternatively the axial projection member 44 may be made of a hard material, for example, steel and may be sharp enough to be inserted into a portion of a wall to which such shelf support is mounted, thereby preventing further rotation of the shelf support.

It should be noted that in all cases a shelf support of the present invention is able to be freely rotatable in at least one direction whilst at least partially mounted to a bore formed within a wall.

Referring to FIGS. 3A-3E, other modifications of a shelf support in accordance with the present invention are shown.

Figure 3A:
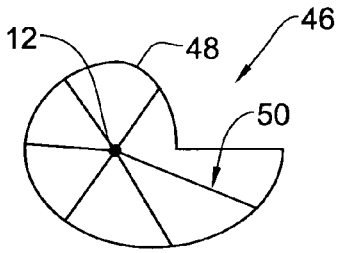
FIG. 3A is a schematic front view of another embodiment of a shelf support comprising radial support spokes.

FIG. 3A illustrates a shelf support 46 with a hollow seating portion, wherein the spiral-shaped outer surface 48 is supported to the rod portion 12 via radial support spokes 50 engaging both.

Figure 3B:
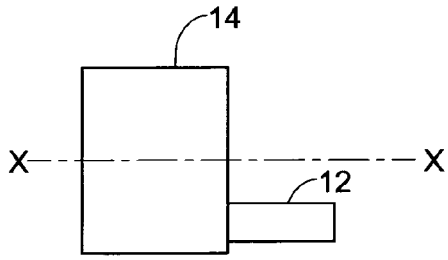
FIG. 3B is a schematic side view of an embodiment of a shelf support comprising an off-centre rod portion and having a circular-shaped seating portion.

FIG. 3B illustrates a shelf support 52 comprising a circular shaped seating portion 14 and an off centre rod portion 12, i.e. a rod portion that is not aligned with the central axis X.

Figure 3C:
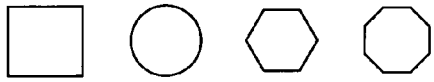
FIG. 3C is a schematic front view of various example alternate shapes for the seating portion of the shelf support in FIG. 3B.

FIG. 3C illustrates various schematic front views of example alternate shapes for the seating portion of the shelf support in FIG. 3B. Notably the shape may be any symmetrical shape or perfected polygon.

Figure 3D:
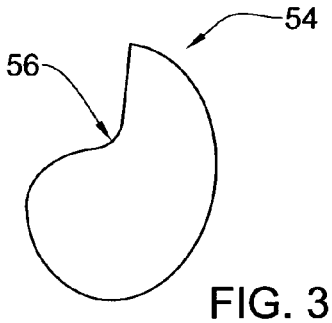
FIG. 3D is a schematic front view of an embodiment of a shelf support comprising an outer surface with a non-spiral shaped portion.

FIG. 3D illustrates a shelf support 54 similar to that shown in FIGS. 1A-1E, comprising an outer surface with a non-spiral shaped curved portion 56 instead the straight portion 21 of shelf support 10. It should be understood that, due to manufacturing realities, small percentages of an outer surface of a shelf support such as the curved portion 56 and the straight portion 21 may have a non-spiral-shape, while not departing from the spirit of the invention.

Figure 3E:
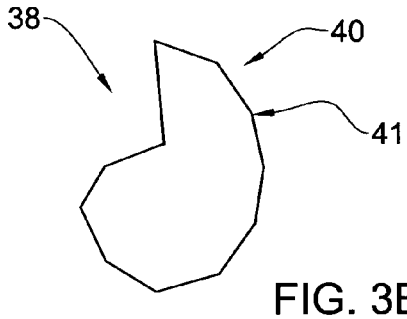
FIG. 3E is a schematic front view of another embodiment of a shelf support having an outer surface formed with discrete flat support surfaces.

FIG. 3E illustrates a shelf support designated as 38 comprising shavings to form discrete flat support surfaces 40, to extend substantially flush under the supported surface of a shelf. Notably the shavings 40 function in a slightly different manner to the unidirectional teeth 32 and bulges 36 shown in FIGS. 2A and 2B, respectively, in that the shavings provide a flat surface for a shelf to rest on thereby removing any incline for a shelf to slip on. Therefore, for slippage to occur a shelf resting on shelf rest 38 would need to overcome an edge or apex 41 by first distancing itself from the shelf rest 38.

Figure 4A:
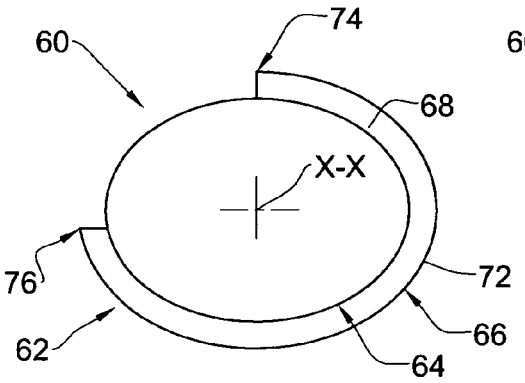
FIG. 4A is a schematic front view of an embodiment of a shelf support comprising an axially-projecting lip.
Figure 4B:
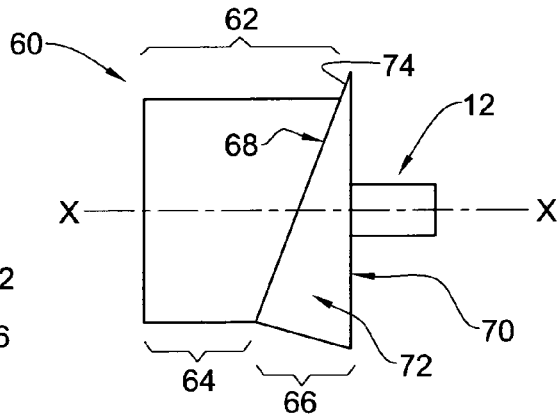
FIG. 4B is a schematic side view of the shelf support of FIG. 4A.

Turning attention to FIGS. 4A and 4B, there is illustrated a shelf support, generally designated as 60. The shelf support 60 comprises a cylindrically-shaped rod portion 12 with a smooth outer surface and a seating portion 62 extending therefrom.

The seating portion 62 comprises a cylindrical section 64, and an axially-projecting lip 66 disposed between the cylindrical section 64 and the rod portion 12.

The lip 66 is of a roughly helical-shape lip and comprises a front axial surface 68, a rear axial surface 70, a side surface 72, a first end 74 (best seen in FIG. 4A) and a second end 76 which extends from the first end 72 around approximately three quarters or 270 degrees of the cylindrical section 64, along which it axially projects in a gradually growing pattern in a direction away from the rod portion 12. The axial projection of the lip at the second end 76 has a magnitude denoted by the letter F (FIG. 4D), the significance of which will become clear hereinafter.

One use of the shelf support 60 will now be described with reference to FIGS. 4C and 4D.

Figure 4C:
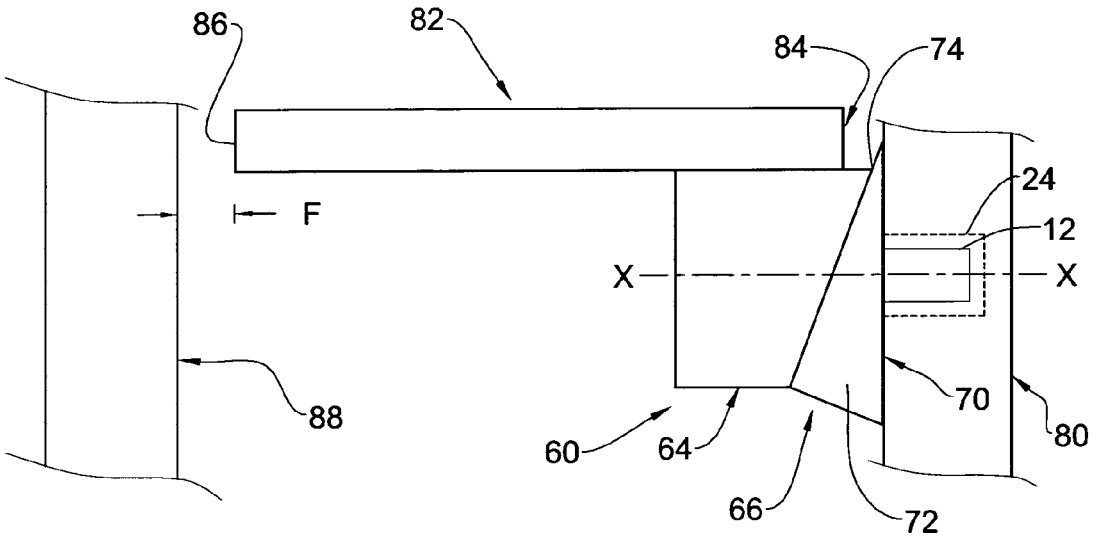
FIG. 4C is a schematic side view of the shelf support of FIG. 4B, mounted to a wall and disposed beneath a shelf.

In FIG. 4C the rod portion 12 of shelf support 60 is mounted to a horizontal bore 24 formed within a first side-wall 80 of a cabinet (partially seen). Mounted on the cylindrical section 64 of the shelf support 60 is a portion of a shelf 82. As can be understood, other portions of the shelf 82 may be supported by additional shelf supports (not shown). Notably a first side-face 84 of the shelf 82 is adjacent the first side-wall 80 of the cabinet with the first end 74 of the lip 66 wedged there between, and a second side-face 86 of the shelf 82 is adjacent a second side-wall 88 of the cabinet, spaced therefrom by a distance of magnitude F.

Figure 4D:
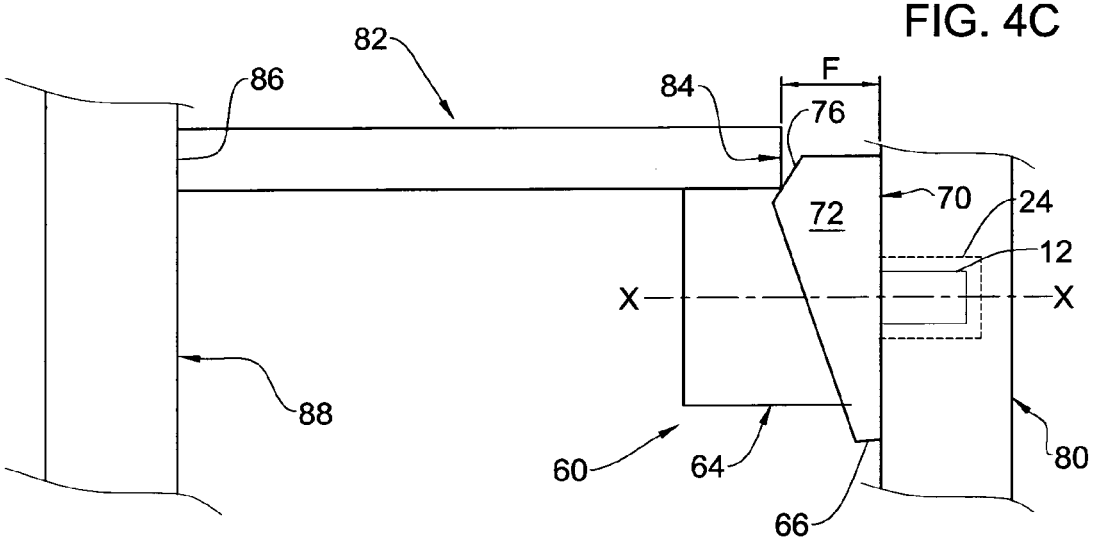
FIG. 4D illustrates the shelf support of FIG. 4C rotated about 270 degrees in a counterclockwise direction.

Turning attention to FIG. 4D, after a user rotates the shelf support 60 counterclockwise by about 270 degrees, the portion of the lip 66 wedged between the first side-face 84 of the shelf 82 and the first side-wall 80 grows, pushing the shelf 82 towards the second side-wall 88, closing the gap therebetween and thus securing the position of the shelf 82.

A further result of the pushing motion is that the shelf support itself is thrust towards the adjacent wall to which it is mounted. Thus the axially-projecting lip also functions as an anti-slip element, preventing the shelf support from being rotated in an undesired direction by moment applied thereon from the adjacent shelf. Therefore there is no need for an anti-slip element, or any securing or locking element. Notably all components of a shelf support of this kind do not protrude and are not visible on the other side of a wall to which the shelf support is mounted.

It should be noted that the axially projecting surface described above may follow any acceptable growth pattern, so as to accomplish the above described function. For example, such shape may also be comprised by an exponential or step growth, etc. It should also be noted that the first end and second end of such a lip may be disposed at different points and extend along different percentages of a seating portion, and also may axially extend in a clockwise direction, as opposed to the counterclockwise direction of growth shown in FIGS. 4A-5E, as long as a growth pattern is present to provide the above described gap-closing function.

Figure 4E:
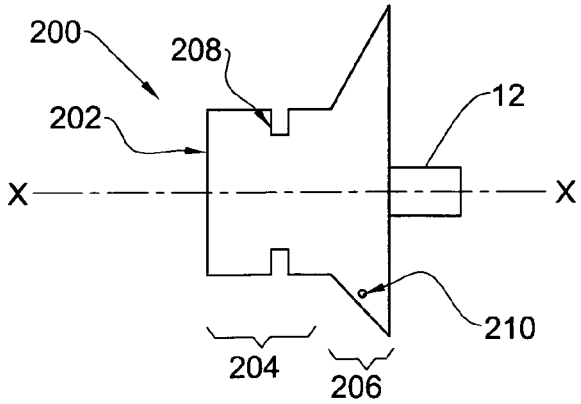
FIG. 4E is a schematic front view of another embodiment of a shelf support comprising an axially-projecting lip.

Alternatively the axially projection of the lip may have a uniform tapered shape as illustrated in FIG. 4E by a shelf support, generally designated as 200.

The shelf support 200 comprises a cylindrically-shaped rod portion 12 with a smooth outer surface and a seating portion 202 extending therefrom.

The seating portion 202 comprises a cylindrical section 204, and an axially-projecting lip 206 disposed between the cylindrical section 204 and the rod portion 12.

The cylindrical section is formed with a radial recess 208 which is designed for engagement with a spanner (not shown) via which a user may turn the shelf support 200 to a desired orientation.

The lip 206 does not follow a growth pattern but has a uniform tapered shape around the diameter of the shelf support 200. The lip 206 is formed with an aperture 210 designed for insertion of a key (not shown) via which a user may turn the shelf support 200 to a desired orientation.

Notably the sizes and positions of the radial recess 208 and aperture 210 may vary according to design preference.

Figure 5A:
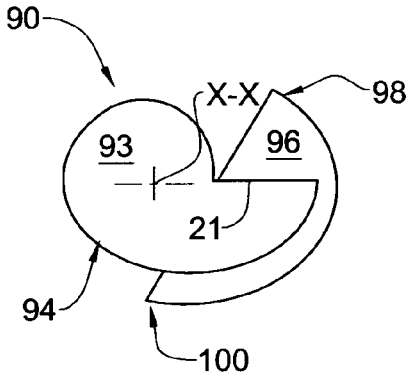
FIG. 5A is a schematic front view of yet another embodiment of a shelf support comprising an axially-projecting lip.
Figure 5B:
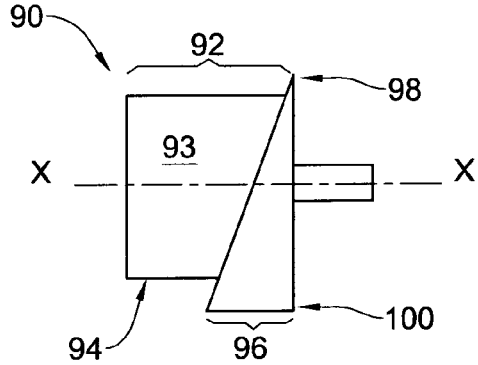
FIG. 5B is a schematic side view of the shelf support of FIG. 5A.

Referring now to FIGS. 5A and 5B, a shelf support generally designated 90 is shown. The shelf support 90 is similar to the shelf support 60 except that the seating portion 92 comprises a first portion 93 having a spiral-shaped outer surface 94 with a straight portion 21, and a second portion constituted by an axially-projecting lip 96 having a first end 98 (best seen in FIG. 5A) and a second end 100 which extends from the first end 98 around approximately half or 180 degrees of the spiral-shaped outer surface 94.

While the shelf support 90 may be used in the manner described above for the previous embodiments, an alternative use will now be described therefor, with reference to FIGS. 5C-5E which illustrate the assembly of a cabinet (partially shown) comprising a back wall 100, a first side wall 102 disposed perpendicular to and adjacent the back wall 100, a second side wall disposed opposite to the first side wall (not shown) and a shelf 104.

Figure 5C:
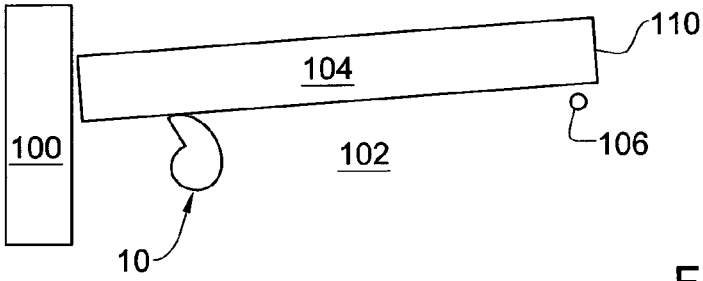
FIG. 5C is a schematic front view of a shelf, side wall and back wall of a cupboard and the shelf support illustrated in FIGS. 1A-1E.

FIG. 5C shows the shelf 104 partially mounted on a shelf support 10, with the shelf 104 slanted upward slightly so that a bore 106, formed with the first side wall 102, is visible.

Figure 5D:
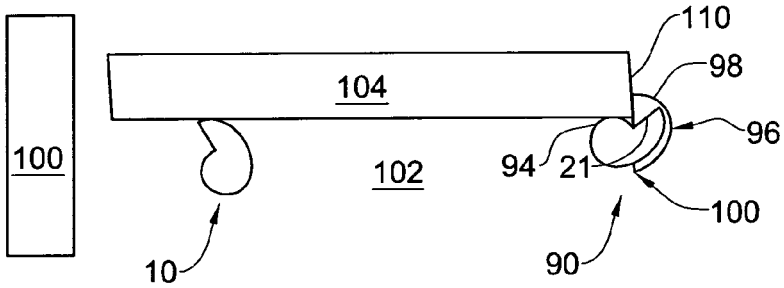
FIG. 5D is a schematic front view of the items in FIG. 5C and the shelf support illustrated in FIGS. 5A and 5B.

In FIG. 5D the shelf support 90 has been mounted to the bore 106, with the shelf 104, still slightly non-level, being brought to rest on a portion of the spiral shaped outer surface 94 thereof. Notably a small portion of the first end 98 of the axially-projecting lip 96 is disposed between the first side wall 102 and the shelf 104.

Figure 5E:
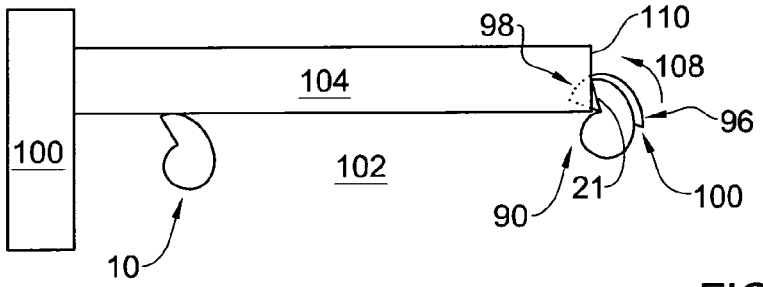
FIG. 5E is a schematic front view of the items in FIG. 5D with the shelf support illustrated in FIGS. 5A, 5B and 5D, rotated counterclockwise.

In FIG. 5E the shelf support 90 has been rotated counterclockwise, i.e. in the direction of arrow 108, until the straight portion 21 of the spiral-shaped outer surface 94 contacts an adjacent side-portion 110 of the shelf 104. This single rotational movement of the shelf support 90 results in the following:

leveling of the shelf 104, as the shelf now rests on a portion of the spiral-shaped outer surface 94 having a smaller diameter than the portion which it was shown to rest on in FIG. 5D;

pushing/securing the shelf 104 against the back wall 100, via the contact of the straight portion 21;

the combination of the downwards force of the shelf 104 on the outer surface 94 caused by gravity and the contact of the shelf 104 with the straight portion 21, causes a self-locking motion, wherein the shelf 104 arrests the shelf support 90 from further rotation; and pushing/securing the shelf 104 away from the first side wall 102 towards the opposing second side wall (not shown), via the lip 96 in a manner similar to that described with reference to FIGS. 4B and 4D.

Those skilled in the art to which this invention pertains will readily appreciate that numerous changes, variations and modifications can be made without departing from the scope of the invention mutatis mutandis.

The invention claimed is:

1. A shelf support comprising a rod portion and a seating portion extending therefrom; the rod portion adapted for fixing to a support wall; the seating portion comprising a spiral-shaped outer surface which constitutes a plurality of support surfaces for supporting a bottom portion of a shelf; wherein, when the rod portion is fixed to the support wall and the bottom portion of the shelf is disposed above the seating portion, rotation of the shelf support causes a portion of the spiral-shaped outer surface to engage the bottom portion of the shelf.

2. The shelf support according to claim 1, wherein the seating portion further comprises shavings to form discrete flat support surfaces.

3. The shelf support according to claim 1, wherein the seating portion further comprises an anti-rotation element.

4. The shelf support according to claim 3, wherein the anti-rotation element is in the form of unidirectional teeth or bulges formed on the spiral-shaped outer surface.

5. The shelf support according to claim 3, wherein the anti-rotation element is in the form of a projection member extending from the seating portion parallel to the rod portion.

6. The shelf support according to claim 1, wherein the seating portion is be hollow, with the spiral-shaped outer surface being connected to the rod portion by spokes.

7. The shelf support according to claim 1, wherein the rod portion is adapted to be freely rotatable in at least one direction while at least partially mounted to a bore in the support wall.

8. The shelf support according to claim 1, wherein the seating portion further comprises an axially-projecting lip.

9. The shelf support according to claim 8, wherein the axial-projecting lip is of a uniform tapered shape or follows a helical, exponential or step growth pattern.

10. The shelf support according to claim 1, wherein the rod portion is a pin engageable within a receiving bore formed in the support wall.

11. A shelf support adapted to be mounted to a bore formed within a wall and to seat a shelf having lower portion and side portions thereon, the shelf support comprising a rod portion and a seating portion extending therefrom; the rod portion being adapted to be rotatably mounted within the bore; the seating portion comprising an axially-projecting lip disposed adjacent to the rod portion, the lip comprising an axial surface constituting a plurality of support surfaces; wherein, when the rod portion is mounted in the bore and the side portion of the shelf is placed adjacent the lip, rotation of the shelf support causes the axial surface to contact the side portion of the shelf.

12. The shelf support according to claim 11, wherein the axially-projecting lip is of a uniform tapered shape or follows a helical, exponential or step growth pattern.

13. The shelf support according to claim 11, wherein the seating portion further comprises a spiral-shaped outer surface which constitutes a plurality of support surfaces for supporting the shelf.

14. A method of supporting a portion of a shelf adjacent a wall and disposed slightly above a bore formed in the wall, the method comprising:

a) providing a shelf support comprising a rod portion and a seating portion extending therefrom, the rod portion being adapted to be mounted to the bore; the seating portion comprising a spiral-shaped outer surface which constitutes a plurality of support surfaces for supporting the shelf;

b) inserting the shelf support in the bore such that the outer surface is not in contact with the shelf; and c) rotating the shelf support until a portion of the spiral-shaped outer surface engages the adjacent portion of the shelf, thereby tuning the orientation of the shelf such that the shelf becomes level.

15. The method according to claim 14, wherein the seating portion further comprises an axially-projecting lip.

16. A method of supporting a shelf having a lower portion and a side portion, the shelf being disposed adjacent a wall and slightly above a bore formed in the wall, the method comprising:

a) providing a shelf support comprising a rod portion and a seating portion extending therefrom, the rod portion being adapted to be mounted to the bore; the seating portion comprising a non-straight portion and a radially-oriented straight portion;

b) inserting the shelf support in the bore and bringing the lower portion of the shelf to be seated on the non-straight portion, while the straight portion thereof is not in contact with the shelf; and c) rotating the shelf support until the straight portion contacts the side portion of the shelf thereby pushing the shelf away from the wall.

17. The method according to claim 16, wherein the non-straight portion is cylindrically shaped or spiral shaped.

18. The method according to claim 16, wherein the seating portion further comprises an axially-projecting lip which during said rotating of the shelf support serves to push the shelf in a direction perpendicular to that caused by the straight portion.

* * * * *